US009498675B2

(12) United States Patent
Walworth

(10) Patent No.: US 9,498,675 B2
(45) Date of Patent: Nov. 22, 2016

(54) NECK THERAPY EXERCISE DEVICE AND METHOD

(71) Applicant: Arnold L. Walworth, Senoia, GA (US)

(72) Inventor: Arnold L. Walworth, Senoia, GA (US)

( * ) Notice: Subject to any disclaimer, the term of this patent is extended or adjusted under 35 U.S.C. 154(b) by 0 days.

(21) Appl. No.: 14/603,622

(22) Filed: Jan. 23, 2015

(65) Prior Publication Data

US 2016/0213973 A1 Jul. 28, 2016

(51) Int. Cl.

*A63B 23/025* (2006.01)
*A63B 21/00* (2006.01)
*A61H 1/02* (2006.01)

(52) U.S. Cl.

CPC ..... *A63B 23/025* (2013.01); *A61H 1/0296* (2013.01); *A63B 21/00185* (2013.01); *A61H 2201/1657* (2013.01); *A61H 2205/04* (2013.01)

(58) Field of Classification Search

CPC ..... A63B 21/00065; A63B 21/045; A63B 21/0608; A63B 21/065; A63B 21/08; A63B 21/22; A63B 21/4003; A63B 23/025; A63B 71/10; A42B 1/004; A42B 4/24; A42B 3/0406; A61H 1/0296

USPC ..... 2/171, 171.2, 174, 209.13, 209.14, 410, 2/422

See application file for complete search history.

(56) References Cited

U.S. PATENT DOCUMENTS

| | | | | |
|---|---|---|---|---|
| 1,530,748 | A * | 3/1925 | Alastalo | A63B 21/0608 482/10 |
| 4,468,023 | A | 8/1984 | Solloway | |
| 4,988,093 | A | 1/1991 | Forrest, Sr. | |
| 6,036,625 | A | 3/2000 | Woodruff | |
| 6,106,437 | A | 8/2000 | Brooks | |
| 6,217,482 | B1 * | 4/2001 | Yoo | A63B 19/00 482/10 |
| 6,939,269 | B2 | 9/2005 | Makofsky | |
| 7,468,019 | B2 | 12/2008 | Zylstra | |
| 7,722,301 | B2 | 5/2010 | Rosenblum | |
| 8,613,690 | B1 | 12/2013 | Thompson | |
| 2011/0287903 | A1 * | 11/2011 | Mathews | A63B 21/0602 482/93 |

FOREIGN PATENT DOCUMENTS

| | | | |
|---|---|---|---|
| CN | 201760035 | U | 3/2011 |
| CN | 202860020 | U | 4/2013 |
| JP | 2011229915 | A | 11/2011 |

* cited by examiner

*Primary Examiner* — Jennifer M Deichl

(74) *Attorney, Agent, or Firm* — J. T. Hollin, Jr. Attorney at Law, P.C.

(57) ABSTRACT

Disclosed is a neck therapy exercise apparatus, comprising a helmet having a weighted flexible rod which may be either permanently or detachably affixed to the top exterior center of the helmet. The flexible rod consists of a first end which may have a connector enabling the attachment of various sized weights to the first end, and a second end, affixed to the helmet. The helmet is custom-sized to a user's head and securely fastened to the head. Therapeutic exercise is accomplished by the user, while wearing the helmet, and weighted flexible rod, slowly rotating his/her head 360 degrees in a generally horizontal plane in either a clockwise or counter-clockwise direction. In different embodiments, the user may replace the weights at the end of flexible rod with increasingly heavier weights as strength is gained during the exercises.

3 Claims, 5 Drawing Sheets

NECK THERAPY EXERCISE DEVICE AND METHOD

CROSS-REFERENCES TO RELATED APPLICATIONS

Not applicable

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

BACKGROUND OF THE INVENTION (1) Field of the Invention

Many persons suffer neck and upper back problems resulting from inadequate muscle strength in the cervical spine. Specific exercises are necessary to strengthen the proper muscles in the neck and upper back area. The muscle structure in those areas is very complex so that it is necessary to recognize the muscles which require strengthening and the manner in which exercise should be enraged in.

Several exercise devices designed to be utilized by direct placement on or near a person's head are known in the prior art. However, no such devices are known to Applicant which include all of the structural features and limitations of the present inventive concept and which permit a full range of neck exercises utilizing the muscles and joints associated with the neck. Proper exercise of the neck area involves a certain amount of resistance, however the resistance must be in the appropriate direction and proportional to the fitness and strength of the user. Compression of the cervical spine must be avoided.

The disclosed inventive concept provides an exercise apparatus which permits specific resistance exercises, with different resistive loads and directions of resistance. Further, there is no application of excessive downward neck load, and thus there is an optimization of cervical muscular therapy.

(2) Description of the Related Art, Including Information Disclosed Under 37 CFR 1.97 and 1.98.

U.S. Pat. No. 8,613,690 B1 (Dec. 24, 2013) Disclosed is a neck therapy device adapted to exercise a user's neck. The device includes a headpiece on which resides a plurality of loops, and through which a strap extends. The headpiece includes a band portion adapted to encircle a user's head like a headband, extending across the user's forehead and back of head. A user typically grasps ends of the strap in order to modulate neck movement.

U.S. Pat. No. 7,722,301 B2 (May 25, 2010). A headgear device for assisting a user in performing bridge exercises to strengthen the muscles of the neck. The headgear outer surface has an area of low-friction material to allow the headgear to slide on an exercise surface while the user's head supports a portion of his body weight in the bridge position, allowing the user to introduce dynamic resistance into the exercise by moving around on the surface. One or more straps connectable to the user's arms and/or legs can be used to provide stability and/or resistance during the exercise.

U.S. Pat. No. 7,468,019 B2 (Dec. 23, 2008). The invention is a neck exercise machine including, a frame, a seat, a set of pulleys, a headband, an adjustable tensioner, and a cable adjustably attached to the headband, threaded through the pulleys, and removably connected to the adjustable tensioner. When a user sits in the seat and attaches the headband, the neck muscles can be exercised in a variety of different angles, rotations, and tensions. Elastic bands, an analog/digital force gauge, or hydraulic cylinder may be used as the adjustable tensioner and incorporate processor, memory, and data output mechanisms for performance analyses.

U.S. Pat. No. 6,939,269 B2 (Sep. 6, 2005). Disclosed is an exercise device for improving head, neck, and spinal alignment, including a bracket having a pair of spaced apart pulleys and a U-shaped base which is adapted to lit over a door, a rope having at least one hand grip attached to one end and a coupler attached to the other end, and a head harness having at least one coupler for mating with the coupler on the rope. The apparatus is used by coupling the bracket to a door, attaching the harness to the user's head and coupling the rope to the harness. From either a standing or sitting position, the user pulls on the hand grip(s) to effect a lifting of the harness.

U.S. Pat. No. 6,036,625 (Mar. 14, 2000). A neck exercise apparatus has a cord and a head strap. The cord is formed from a highly elastic, rubberized tube and has a mounting strap secured to one end. A spring clip is secured to the opposite end of the mounting strap. A foam rubber pad surrounds each end of the tube. The head strap has a flexible, inelastic body with two hook and loop fastening straps on each end. The body also has several rings on an outer side and an elastic head support on an inner side. Prior to performing exercises, the mounting strap is inserted between a door and its inner door jamb so that the mounting strap is held in place. The user attaches the spring clip to one of the rings and the head strap is placed on the head. The head strap may be adjusted for fit by adjusting, the position of the hook and loop flaps. With tension in the cord, the user then exercises the extension muscles of the neck by slowly tilting the head at the neck away from the door.

U.S. Pat. No. 6,106,437 (Aug. 22, 2000). A neck therapy exercise apparatus comprises a resistance frame in the form of a circular ring at head level of the user. The resistance frame is equipped with pulleys and a user wears a helmet with attachment eyes thereon. Weights are attached to cords which pass through the pulleys and are hooked to selected eyes on the helmet. Cervical spine muscle exercises are done against resistance which is in the plane of the head to prevent downward loading on the spine. More than one weight and cord can be used at the same time to provide torque resistance about a vertical axis. Hand grips are provided to maintain position of the torso.

U.S. Pat. No. 4,988,093 (Jan. 29, 1991). Disclosed is a fluid filled neck exerciser which features an annulus filled with a fluid such as water and/or air and a head support device. The head support device has attachment members allowing the removable attachment of the annulus. The annulus may be selectively filled with a desired amount of fluid and with the device placed on the head of the user, the head then rotated to perform exercises U.S. Pat. No. 4,468,023 (Aug. 28, 1984). An aquatic helmet exercise assembly is provided which can be interchangeably used by men, women and children alike in the water without substantial modification by simply adjusting the chin straps. The aquatic helmet exercise assembly permits a large range of head movements and controlled use of fluid resistive threes for strengthening the neck, back and stomach muscles.

CN20102504677U (Aug. 25, 2010). The invention is a neck exercise instrument, which can prevent cervical spondylosis by means of exercising the neck of the human body. Included is a head fixing fastened transverse strap and a cap frame consisting of a plurality of vertical semicircular top straps, a drawing rope connected to the top of the cap frame, a counterweight sand-containing ball connected to a far end of the drawing rope and two lower jaw connecting fasteners are symmetrically arranged on two sides below the cap frame. A user wears the cap frame on the head, and the neck of the user can be exercised and moved by means of swinging the head to drive the sand-containing ball to rotate.

JP20100098271 (Apr. 6, 2010). The invention allows stretching of the scruff of the neck and the muscles of the shoulders. In this case, an assisting implement is attached to the head, and a protrusion provided at the assisting implement is pushed and pulled with the hand. The scruff of the neck and the muscles of the shoulders are thereby loosened to achieve effective gymnastics only by slightly turning or inclining the neck.

CN20122343429U (Jul. 16, 2012). Disclosed is a neck muscle force trainer, which comprises a head training hat, an elastic rope and a fixing device for fixing the elastic rope, which are all connected in sequence. Further, included is a neck muscle force trainer which comprises a head training hat, a hanging rope connected with the opening of the head training hat from one end to the other end in the diameter direction, and a counterweight hung on the hanging rope. The device can train multidirectional muscle groups of the neck, and can also perform multidirectional training with different resistances to the neck.

BRIEF SUMMARY OF THE INVENTION

The disclosed inventive concept, a neck therapy exercise apparatus, comprises a helmet with at least one weighted flexible rod which may be either permanently or detachably fixed to the helmet. The flexible rod consists of a first end having a connector enabling the attachment of various sized weights to the first end, and a second end, affixed to the helmet A user of the device wears a custom-sized helmet securely fastened to his/her head. The therapeutic exercise is accomplished by the user, while wearing the helmet and weighted flexible rod, slowly rotating his/her head 360 degrees in a generally horizontal plane in either a clockwise or counter-clockwise direction. The rotation is repeated for a specified number of full revolutions. Afterwards, the user rotates the head the same number of revolutions in the opposite direction. The weight of the flexible rod, or attached weights may be increased as the user's strength increases.

DETAILED DESCRIPTION OF THE INVENTION

The objects, features, and advantages of the concept presented in this application are more readily understood when referring to the accompanying drawings. The drawings, totaling nine figures, show the basic components and functions of embodiments and/or methods of use. In the several figures, like reference numbers are used in each figure to correspond to the same component as may be depicted in other figures.

Figure 1:
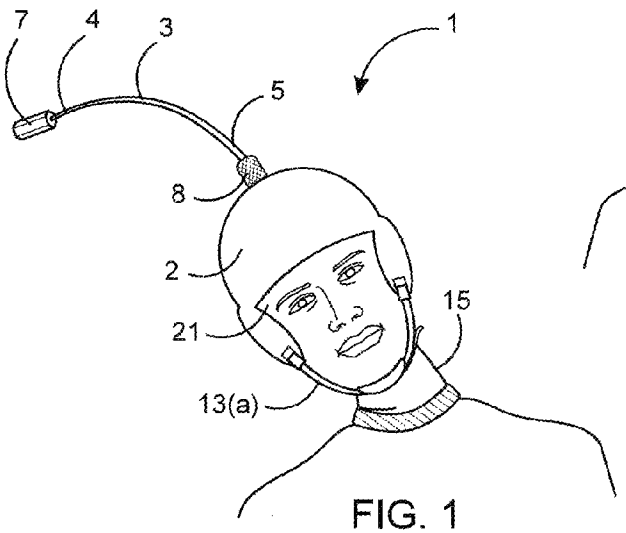
FIGS. 1, 2, and 3 display three of the multiple positions which may be reached by a user during rotation of the head about the neck while wearing the neck exerciser.
Figure 2:
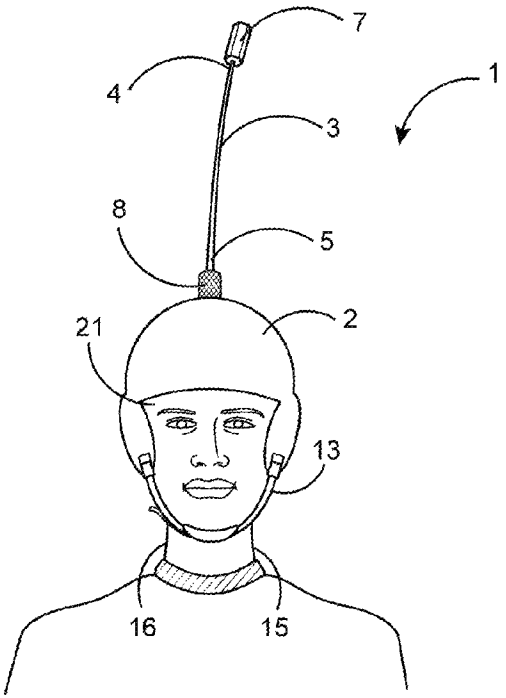
Figure 3:
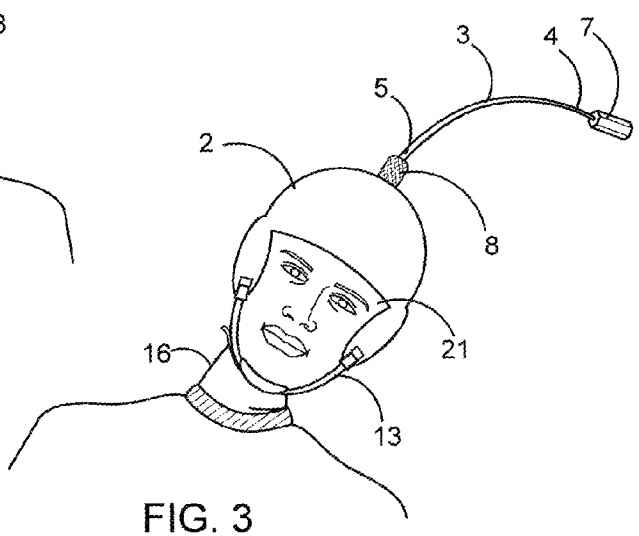

The discussion of the present inventive concept will be initiated with the combined viewing of FIG. 1, FIG. 2, and FIG. 3. In these figures the functionality of the neck exerciser 1 is demonstrated by three different head 21 positions which a user may momentarily pass through while exercising with the neck exerciser 1. FIGS. 1, 2, and 3 depict a user performing a slow rotation of the head 21. The rotation of the head 21 necessarily and simultaneously engages the neck muscles on the left side 15 and right side 16 of the neck, and associated ligaments.

FIG. 1 depicts the user with his/her head 21 tilted to the user's right.

FIG. 2 depicts the user's head 21 in a relatively upright head 21 position.

FIG. 3 illustrates the user's head 21 tilted to the user's left. In actual use of the neck exerciser 1, the user is expected to achieve the leftmost and rightmost head 21 positions during slow rotation of the head 21 in either a clockwise or counterclockwise pattern, the patterns being in essentially a horizontal orientation.

In viewing FIGS. 1, 2, and 3, it is further seen that the neck exerciser 1 is retained on the user's head 21 by a bi-sectioned chin strap 13 which is affixed to the left and right sides of the helmet 2 by snap fasteners (or press studs), or permanent attachment, and is length-adjustable by a strap-and-buckle type closure. In essence, the neck exerciser 1 is shown to comprise a helmet 2 with a flexible rod 3. The flexible rod 3 is affixed at the top center of the exterior of the helmet 2, equidistant from the user's left and right ears by means of a knurled rod fastener 8. The flexible rod 3 may be of variable lengths, diameters, weights, and also constructed from a variety of different materials. Further, the flexible rod 3 may be removed from the helmet 2 by a providing a rod fastener 8 having a means of detaching the flexible rod 3 from the knurled rod fastener 8. The flexible rod 3 may be constructed from a variety of semi-rigid materials, including, but not limited to, fiberglass, plastic, rubber, metal, and composite materials.

As shown in FIGS. 1, 2, and 3, the flexible rod 3 consists of a first end 4 and a second end 5. In the embodiment shown in these figures, the first end 4 of the flexible rod 3 is constructed with a detachable and appropriately-sized weighted object 7. In different embodiments of the device, a variety of connecting means may be used for the attachment of various sized weights to the first end 4 of the flexible rod 3. The second end 5 of the flexible rod 3 is constructed so as to provide a means by which the second end 5 of the flexible rod 3 is attached to the helmet 2 by a knurled rod fastener 8. The flexible rod 3 may be compatibly attached to various types of rod fasteners atop the helmet 2. A user of the neck exerciser 1 must wear a custom-sized helmet 2, specifically fitted for the user's head 21, and including a strap 13 to securely fasten the helmet 2 to the user's head 21.

Figure 4:
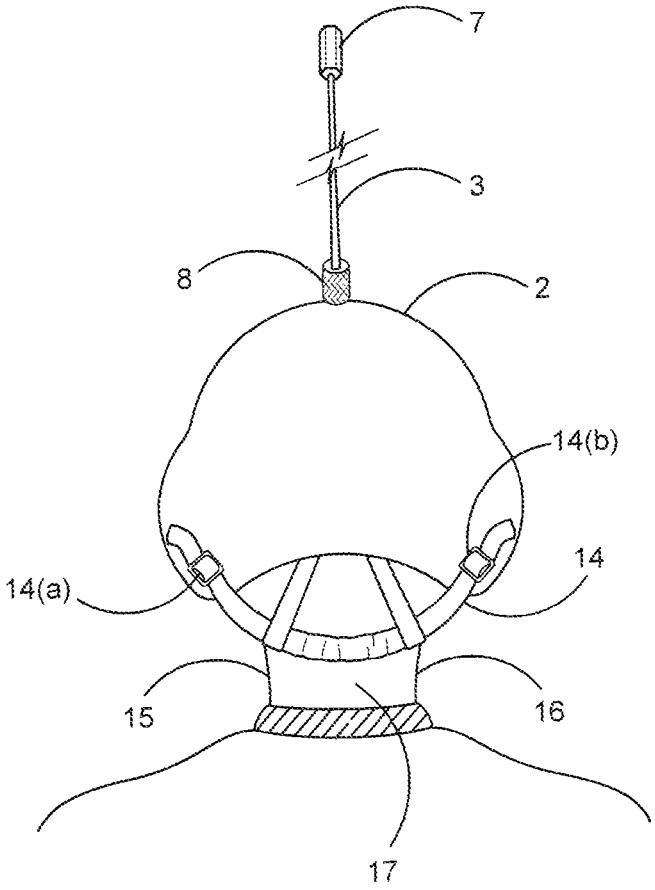
FIG. 4 is a view showing the back of a user's neck 17, including the back of the helmet 2, the flexible rod 3, and a weight 7.

FIG. 4 depicts a rear view of a user while wearing the helmet 2 of the neck exerciser 1 with the additional fastening mechanism of a neck strap 14. The neck strap 14 is attached to the helmet 2 by means of a multi-sectioned strap 14 which is affixed to the left and right sides of the helmet 2 by snap fasteners (or press studs), is adjustable by two strap-and-buckle type closures, being an adjustable right buckler 14(*a*) and an adjustable left buckler 14(*b*). The neck strap 14 gives further stability and a more secure mounting of the helmet 2 upon a user's head 21.

Figure 5:
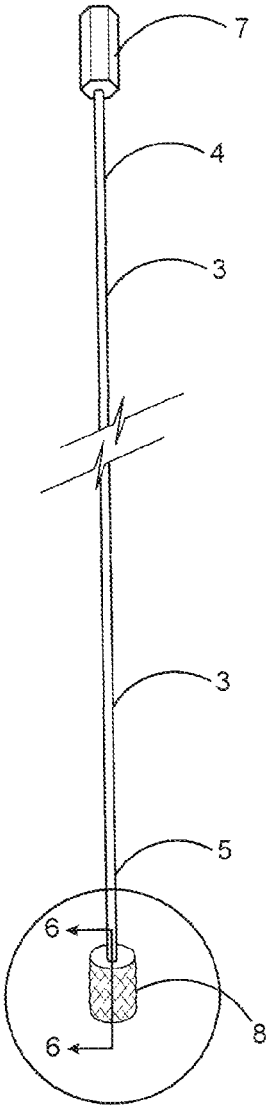
FIG. 5 illustrates an embodiment of a flexible rod 3 having a weight 7 attached to the first end of the flexible rod 3 and a rod fastener 8 attached to the second end of the flexible rod.
Figure 6:
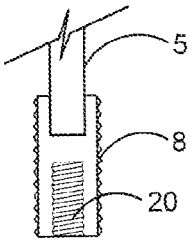
FIG. 6 depicts a sectioned view of a rod fastener 8, further showing its internal threads 20.
Figure 7:
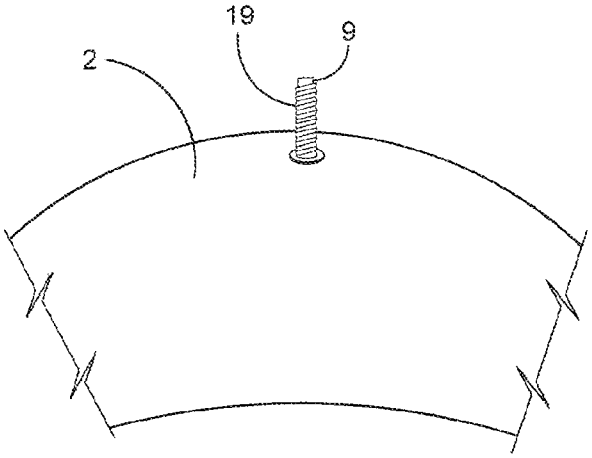
FIG. 7 shows an embodiment of a helmet connector 9 comprising a protruding, threaded cylindrical structure.

FIG. 5 illustrates an embodiment of a flexible rod 3 having a detachable weight 7 attached to the first end 4 of the flexible rod 3 and further, having a knurled rod fastener 8 attached to the second end 5 of the flexible rod. FIG. 6 presents a sectional view of the knurled rod fastener 8 as seen from section line 6-6 in FIG. 5. The knurled rod fastener 8 is shown to have a cavity comprising internal threads 20. In viewing FIG. 6, it is also seen that the second end 5 of the flexible rod 3 is permanently embedded in the upper portion of the knurled rod fastener 8. Viewing FIG. 7, there is shown a protruding, cylindrical, threaded helmet connector 9, having external threads 19 corresponding to the threaded cavity 20 of the knurled rod fastener 8. The helmet connector 9 is permanently affixed to the top exterior surface of the helmet 2. In the embodiment of the neck exerciser 1 depicted in FIGS. 5, 6, and 7, the flexible rod 3 must be mounted atop the helmet 2 by means of rotating the knurled, rod fastener 8 onto the threaded helmet connector 9.

Figure 8:
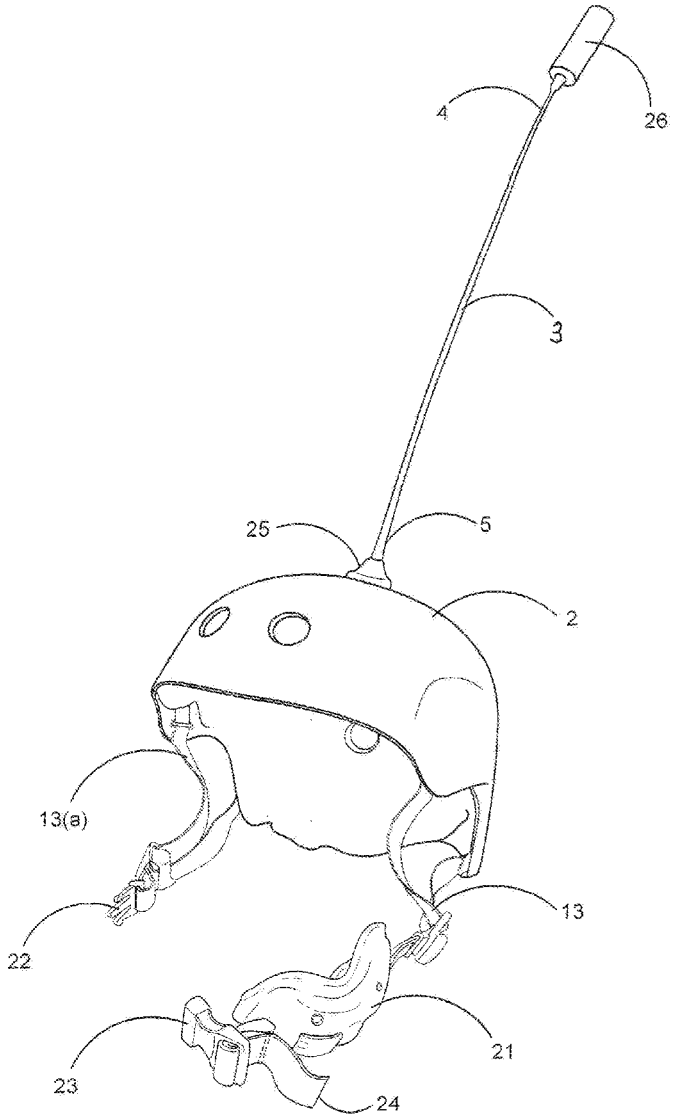
FIG. 8 depicts an embodiment of the helmet 2 having a reinforced chin strap 32, an integral, fixed rod connector 25, and an integral weight 26.

Turning to FIG. 8, there is shown a frontal view of an embodiment of the neck exerciser 1 having a flexible rod 3 that that may be attached to, or removed from, the helmet 2 by means of a varying selection of detachable helmet connectors 25. The flexible rod 3 shown in FIG. 8 is further fabricated with a permanently attached weighted object 26 affixed to first end 4 of the flexible rod 3. The stylized detachable helmet connector 25 shown in FIG. 8 may be attached to the helmet 2 by means of a flexible rod 3 having an exteriorly-threaded base corresponding to matching interior threads in the top exterior of the helmet 2. In some embodiments of the neck exerciser 1, the flexible rod 3 may be permanently attached to the top of the helmet 2.

The helmet 2 shown in FIG. 8 is further equipped with a reinforced chin protector 32. The reinforced chin protector 32 is attached to the helmet 2 by means of a right chin strap 13(*a*) and a left chin strap 13(*b*), which lead to an attaching prong 22 and a prong receptacle 23, respectively. The reinforced chin protector 32 gives additional stability and a more secure mounting of the helmet 2 upon a user's head 21.

Figure 9:
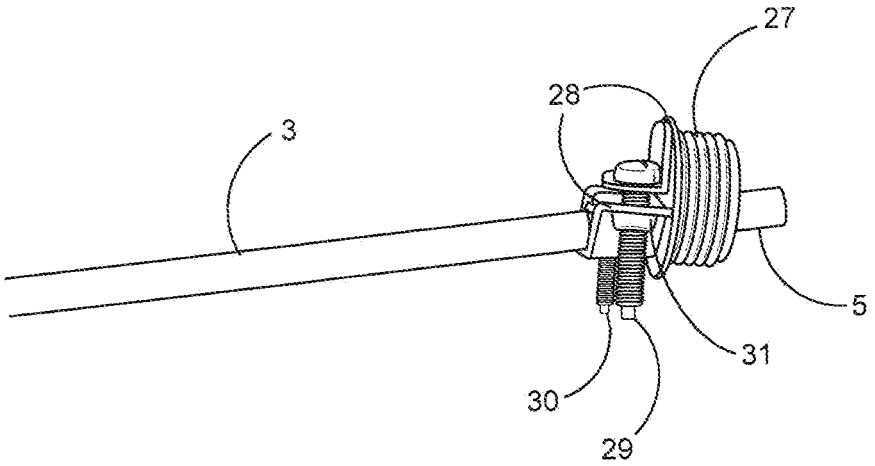
FIG. 9 is a depiction of a flexible rod-helmet connecting mechanism comprising a threaded base 27 and a pair of brackets and machine screws for retention of the flexible rod.

A different embodiment of a detachable helmet connector 25 is shown in FIG. 9. FIG. 9 illustrates a flexible rod 3, the second end 5 of which has been inserted into a threaded base 27 assembly. The flexible rod 3 is maintained in position within the threaded base 27 by means of two L-brackets 28 interconnected by two machine screws 29, 30 and two corresponding nuts 31. The helmet 2 utilized in this embodiment is constructed with internal threads corresponding to the threads of the threaded base 27.

Other means of connecting the flexible rod 3 to the helmet 2 include a detachable helmet connector 25 having a ratchet with a gear and releasable pawls, and a detachable helmet connector 25 having ball and socket joints interconnected between the second end 5 of the flexible rod 3 and the helmet 2.

As previously mentioned, the therapeutic exercise enabled by the neck exerciser 1 is accomplished by the user, while wearing the helmet 2 and flexible rod 3, slowly rotating his/her head 21 360 degrees in a generally horizontal plane, either clockwise or counter-clockwise. The rotation is repeated, if the user is able, for at least ten (10) full cycles, after which, the same number of head 21 rotations may be performed in the opposite direction.

The rotation of the user's head 21 in a 360-degree, generally circular pattern, while wearing the neck exerciser 1, will cause an extensive stretching and slight compression of the neck muscles 15, 16 and associated ligaments. The rotation will necessarily cause the user's head 21 to tilt slightly back at one point, and 180 degrees later in the rotation pattern, cause the head 21 to tilt slightly forward. After completion of the first cycle of two opposing rotations, the user may incrementally increase the augmented weight attached to the flexible rod 3, and may also increase the speed of rotation of the head 21 if desired.

Using a commercially available embodiment of the neck exerciser 1, a person using the neck exerciser 1 for the first time, or at the start of a slow rehabilitative program, may perform the head 21 rotations with only the flexible rod 3 attached to the helmet 2. After a warm-up period, or the gradual strengthening of the neck muscles 15, 16, the user may attach a light weighted object 7 selected from a group of variedly-sized weights to the first end 4 of the flexible rod 3.

The first end 4 of the flexible rod 3 may be constructed with an attachment means whereby the user may select from appropriately sized weights to attach to the first end 4 of the flexible rod 3. A user operates the apparatus by first selecting a flexible rod 3 of the appropriate weight and flexibility (or a detachable weighted object to the end of the flexible rod 3) and then strapping the helmet 2 securely on the head 21. After completing a series of head 21 rotations, the user may then remove the flexible rod 3 and/or the weighted object (depending on the embodiment of the neck exerciser 1 in use) and replace either with a second, incrementally heavier flexible rod 3 and/or weight to begin performing progressive cycles of neck exercises.

While preferred embodiments of the present inventive concept have been shown and disclosed herein, it will be obvious to those persons skilled in the art that such embodiments are presented by way of example only, and not as a limitation to the scope of the inventive concept. Numerous variations, changes, and substitutions may occur or be suggested to those skilled in the art without departing from the intent, scope, and totality of this inventive concept. Such variations, changes, and substitutions may involve other features which are already known per se and which may be used instead of, in combination with, or in addition to features already disclosed herein. Accordingly, it is intended that this inventive concept be inclusive of such variations, changes, and substitutions, and by no means limited by the scope of the claims presented herein.

What is claimed is:

1. An apparatus for therapeutically exercising the neck muscles and ligaments of a user, being configured to the head of the user, comprising:

a helmet having an interiorly threaded cavity, constructed at the top center exterior surface of said helmet, said interiorly threaded cavity comprising a helmet connector;

a left strap having a first end and a second end and a right strap having a first end and a second end, wherein the first end of each of said straps is respectively affixed to the left side and right side of said helmet, said straps further having complementary parts of a strap-and-buckle closing mechanism connected to the second end of each strap, thereby allowing the fastening together of said straps proximate the chin of a user;

a flexible rod having a first end and a second end, wherein the first end of said flexible rod comprises an exteriorly-threaded segment;

a threaded circular base having an upper surface and a lower surface, a through-hole of a diameter corresponding to the second end of said flexible rod, and further comprising exterior threads corresponding to the interiorly-threaded cavity of said helmet connector;

two L-brackets, each with two drilled apertures, said L-brackets oriented in a parallel, opposite-facing manner and each permanently affixed to the upper surface of said threaded circular base;

two machine screws, each one insertable through the respective opposing apertures of each L-bracket, and two threaded nuts corresponding to the threads of said machine screws, whereby said circular base may be inserted into the helmet connector, the second end of said flexible rod may be inserted within the through-hole proximate said al-brackets, then securely attached to the threaded circular base by means of said machine screws and nuts tightened against the two L-brackets; and a plurality of incrementally-weighted objects, all having internal threads of a configuration and dimensions corresponding to the exteriorly-threaded segment of the first end of said flexible rod.

2. A device as in claim 1, wherein said flexible rod comprises a length in the range of ten to twenty-four inches (10.0" to 24.0"), a diameter of 3/16 of an inch, and a weight in the range of two (2.0) ounces to eight (8.0) ounces.

3. A device as in claim 1, wherein said flexible rod comprises a length of twenty-four inches (24.0"), a diameter of 3/16 of an inch, and a weight in the range of two (2.0) ounces to eight (8.0) ounces.

* * * * *